US007330152B2

(12) United States Patent
Zhang et al.

(10) Patent No.: US 7,330,152 B2
(45) Date of Patent: Feb. 12, 2008

(54) RECONFIGURABLE, MICROSTRIP ANTENNA APPARATUS, DEVICES, SYSTEMS, AND METHODS

(75) Inventors: Shenghui Zhang, Beijing (CN); Jennifer T. Bernhard, Champaign, IL (US); Gregory H. Huff, Champaign, IL (US); Garvin Cung, Columbia, MD (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 34 days.

(21) Appl. No.: 11/257,382

(22) Filed: Oct. 24, 2005

(65) Prior Publication Data

US 2007/0229357 A1 Oct. 4, 2007

Related U.S. Application Data

(60) Provisional application No. 60/692,424, filed on Jun. 20, 2005.

(51) Int. Cl.
*H01Q 1/38* (2006.01)

(52) U.S. Cl. ..... 343/700 MS; 343/834

(58) Field of Classification Search ..... 343/700 MS, 343/795, 767, 834, 833
See application file for complete search history.

(56) References Cited

U.S. PATENT DOCUMENTS 4,933,682 A 6/1990 Vaughan
5,767,807 A * 6/1998 Pritchett ..... 342/374
6,384,797 B1 5/2002 Schaffner et al.
6,501,427 B1 * 12/2002 Lilly et al. ..... 343/700 MS
6,563,467 B1 5/2003 Buris et al.
6,762,719 B2 7/2004 Subotic et al.
6,774,844 B2 8/2004 Subotic et al.
6,816,116 B2 11/2004 Chen
6,844,852 B1 1/2005 Simons
6,864,848 B2 3/2005 Sievenplper
6,876,330 B2 4/2005 Alexeff et al.
6,876,337 B2 4/2005 Larry
7,129,897 B2 * 10/2006 Iigusa et al. ..... 343/700 MS
7,132,992 B2 * 11/2006 Mori ..... 343/770
2006/0240882 A1 * 10/2006 Nagy et al. ..... 455/575.7

OTHER PUBLICATIONS

Harrington, Roger F., Reactively Controlled Directive Arrays, journal, May 1978, vol. AP-26, No. 3, IEEE.

Hirasawa, K., et al., On Electronically-Beam-Controllable-Dipole Antenna, journal, 1980, pp. 692-695, IEEE.

(Continued)

*Primary Examiner*—Hoanganh Le
(74) *Attorney, Agent, or Firm*—Krieg DeVault LLP; L. Scott Paynter

(57) ABSTRACT

An antenna device includes a dielectric layer, an electrical ground layer carried on one side of the dielectric layer, and an antenna arrangement carried on another side of the dielectric layer. This arrangement includes two parasitic microstrip elements and a microstrip signal element. The signal element is structured to radiate an electromagnetic signal in response to application of a corresponding electrical communication signal. The parasitic antenna elements extend along opposing longitudinal sides of the signal element and each includes an adjustable component operatively connected between two microstrips. The adjustable component is structured to selectively adjust operable length of a selected one of the parasitic antenna elements to change a maximum radiation direction of the antenna device.

22 Claims, 18 Drawing Sheets

OTHER PUBLICATIONS

Fassetta, S., et al., Switched Angular Diversity BSSA Array Antenna for WLAN, journal, Apr. 13, 2000, pp. 702-703, vol. 36, No. 8, Electronics Letters.
Ohira, T., et al. Electronically Steerable Passive Array Radiator Antennas for Low-Cost Analog Adaptive Beamforming, journal, pp. 101-104, IEEE, no date.
Maloney, J., et al., Switched Fragmented Aperture Antennas, journal, 2000, pp. 310-313, IEEE.
Jung-Chih Chiao, et al., MEMS Reconfigurable Antennas, journal, Mar. 15, 2001, pp. 301-309, John Wiley & Sons, Inc.
Li, R.L., et al., Pattern Shaping Using a Reactively Loaded Wire Loop Antenna, journal, Jun. 2001, pp. 203-208, vol. 148, No. 3, IEE Proc. Microw. Antennas Propag.
Lu, J.W., et al., Multi-Beam Switched Parasitic Antenna Embedded in Dielectric for Wireless Communication, journal, Jul. 5, 2001, p. 871, vol. 37, No. 14, Electronics Letters.
Li, R.L., et al., Steerable Reactively Loaded Microstrip Loop Antenna, journal, 2001, pp. 788-791, IEEE.
Vinoy, K.J., et al., Hilbert Curve Fractal Antennas with Reconfigurable Characteristics, journal, 2001, pp. 381-384, IEEE MTT-S Digest.
Yang, et al., A Reconfigurable Patch Antenna Using Switchable Slots for Circular Polarization Diversity, journal, Mar. 2002, pp. 96-98, vol. 12, No. 3, IEEE.
Scott, H., et al., Polarization Agile Circular Wire Loop Antenna, journal, 2002, pp. 64-66, vol. 1, IEEE Antennas and Wireless Propagation Letters.
Janapsatya, J., et al., Analysis of an Array of Monopoles with the Use of a Radial Waveguide Approach, journal, Aug. 20, 2002, vol. 34, No. 4, Wiley Periodicals, Inc.
Xiso, S., et al., Reconfigurable Microstrip Antenna Design Based on Genetic Algorithm, journal, 2003, pp. 407-410, IEEE.
Wahid, P.F., et al., A Reconfigurable Yagi Antenna for Wireless Communications, journal, Jul. 20, 2003, vol. 38, No. 2, Wiley Periodicals, Inc.
Huff, G.H., et al., A Novel Radiation Pattern and Frequency Reconfigurable Single Turn Square Spiral Microstrip Antenna, journal, Feb. 2003, pp. 57-59, vol. 13, No. 2, IEEE.
Fassetta, et al., Low-Profile Circular Array of Equilateral Triangular Patches for Angular Diversity, journal, Feb. 2003, pp. 34-36, vol. 150, No. 1, IEE.
Cheng, et al., Electronically Steerable Parasitic Array Radiator Antenna for Omni- and Sector Pattern Forming Applications to Wireless Ad Hoc Networks, Aug. 2003, IEE.
Schlub, R., et al., Seven-Element Ground Skirt Monopole ESPAR Antenna Design From a Genetic Algorithm and the Finite Element Method, Nov. 2003, vol. 51, No. 11, IEEE.
Zhang, S., et al., A Pattern Reconfigurable Microstrip Parasitic Array, journal, Oct. 2004, pp. 2773-2776, vol. 52, No. 10, IEEE.
Scott, H., et al., 360 Electronic Ally Controlled Beam Scan Array, journal, Jan. 2004, pp. 333-335, vol. 52, No. 1, IEEE.
Zhang, S., et al., Three Variations of a Pattern-Reconfigurable Microstip Parasitic Array, journal, Jun. 5, 2005, pp. 369-372, vol. 45, No. 5, Wiley Periodicals, Inc.

* cited by examiner

RECONFIGURABLE, MICROSTRIP ANTENNA APPARATUS, DEVICES, SYSTEMS, AND METHODS

CROSS-REFERENCE TO RELATED APPLICATIONS

The present application claims the benefit of U.S. Provisional Patent Application No. 60/692,424 filed 20 Jun. 2005, which is hereby incorporated by reference in its entirety.

GOVERNMENT RIGHTS

This invention was made with Government support under Contract Number ESC-9983460 awarded by the National Science Foundation. The Government has certain rights in the invention.

BACKGROUND

The present invention relates to antenna devices, and more particularly, but not exclusively relates to methods, systems, devices, and apparatus involving reconfigurable antennas.

There has been a growing demand for wireless communication devices that have reduced antenna bulk, faster data transfer rate, less power use, and/or better Signal-to-Noise Ratio (SNR)—particularly for battery-powered portable wireless devices. Accordingly, more flexible, reconfigurable antenna designs have become the subject of research and development efforts. Such efforts have focused on reconfiguring antenna frequency, polarization, phase, and radiation pattern. Pattern reconfigurability offers promise in several areas, such as pattern steering to increase SNR, save power, avoid jamming, and improve security. Thus, there continues to be a demand for further contributions in this technological area.

SUMMARY

One embodiment of the present invention is a unique reconfigurable antenna. Other embodiments include unique methods, systems, devices, and apparatus involving one or more reconfigurable antennas. Further embodiments, forms, features, aspects, benefits, and advantages of the present application shall become apparent from the description and figures provided herewith.

DETAILED DESCRIPTION OF SELECTED EMBODIMENTS

Figure 1:
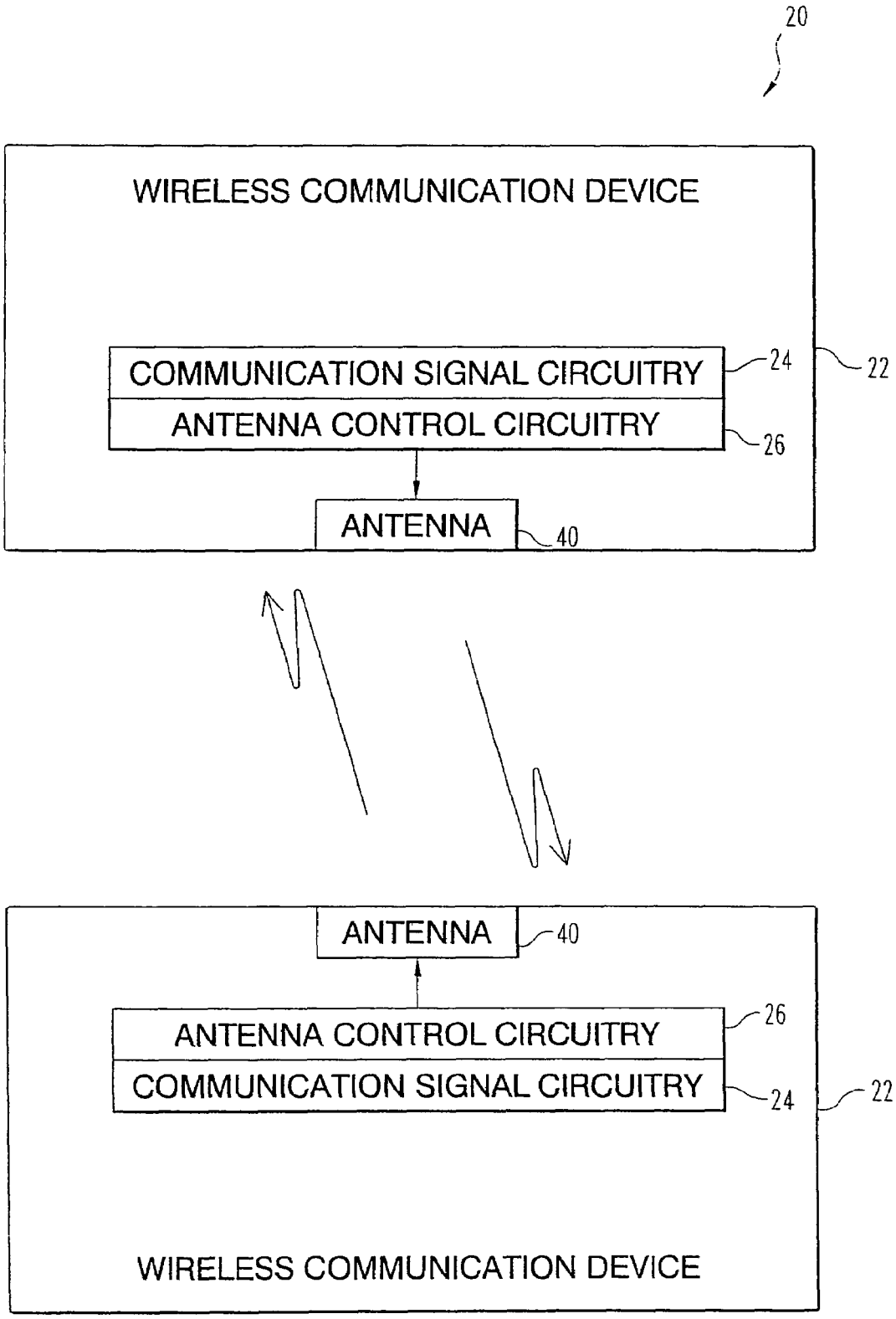
FIG. 1 is a diagrammatic view of a wireless communication device system.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

In one embodiment of the present invention, a multielement microstrip antenna provides radiation pattern reconfigurability. In one form, three linear microstrip elements are included that are carried on a thin substrate backed with a finite ground plane. The center microstrip element is operatively connected to a communication signal source, while the other two microstrip elements are each arranged about the center element with one or more pattern radiation pattern adjustment components in the form of switches, varactors, PIN diodes, capacitors, inductors, a combination of these, or the like.

FIG. 1 illustrates wireless communication device system 20 of another embodiment of the present invention. System 20 depicts two wireless communication devices 22. Devices 22 can be of any type, including but not limited to a computer with wireless networking, a mobile telephone, a wireless Personal Digital Assistant (PDA), a video display device, and/or an audio device, just to name a few examples. Devices 22 each include components, programming, and circuitry suitable to its particular application (not shown), and also include communication signal processing circuitry 24 and antenna control circuitry 26 operatively coupled to antenna 40. Devices 22 are arranged to perform bidirectional communications with antennas 40; however, in other embodiments one or more of devices 22 may communicate in one direction only (unidirectionally).

Circuitry 24 is configured to provide appropriate signal conditioning to transmit and receive desired information (data), and correspondingly may include filters, amplifiers, limiters, modulators, demodulators, CODECs, digital signal processing, and/or different circuitry or functional components as would occur to those skilled in the art to perform the desired communications. Circuitry 26 is adapted to control various configurations that can be provided with antenna 40 as further described hereinafter.

Figure 21:
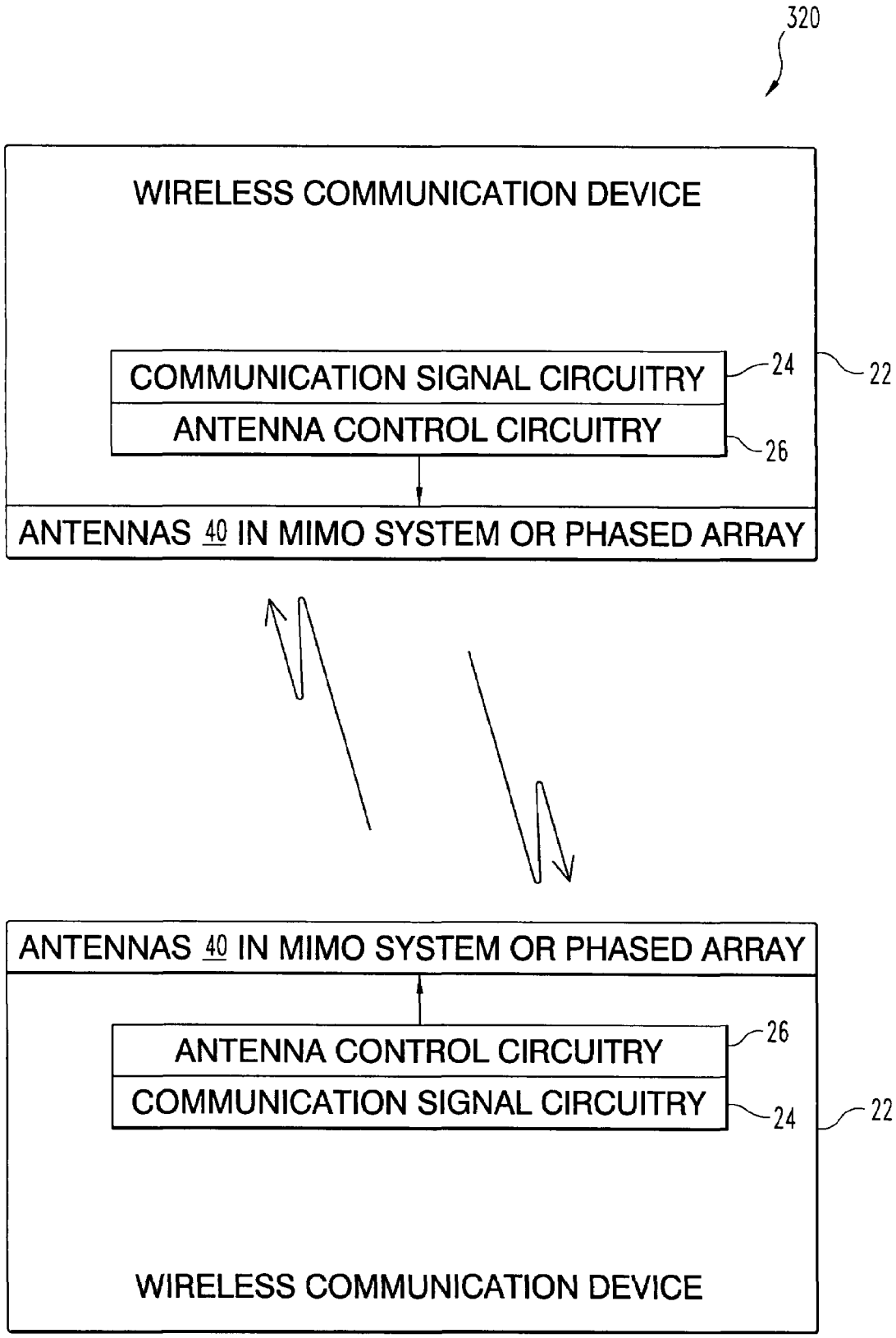
FIG. 21 is a diagrammatic view of a wireless communication device system.

In one nonlimiting form, circuitry 26 includes processing to automatically determine and select a suitable antenna configuration and to automatically change configurations in response to degradation of communication conditions or the like. Nonetheless, in other forms, reconfiguration may additionally or alternatively be performed manually or use such other techniques as would occur to those skilled in the art. Also, it should be appreciated that while only one antenna 40 is depicted for each of devices 22, multiple antennas 40 can be utilized to implement a Multiple-Input Multiple-Output (MIMO) communication system and/or a phased antenna array. See system 320 of FIG. 21; where like reference numerals refer to like features previously described.

Figure 2:
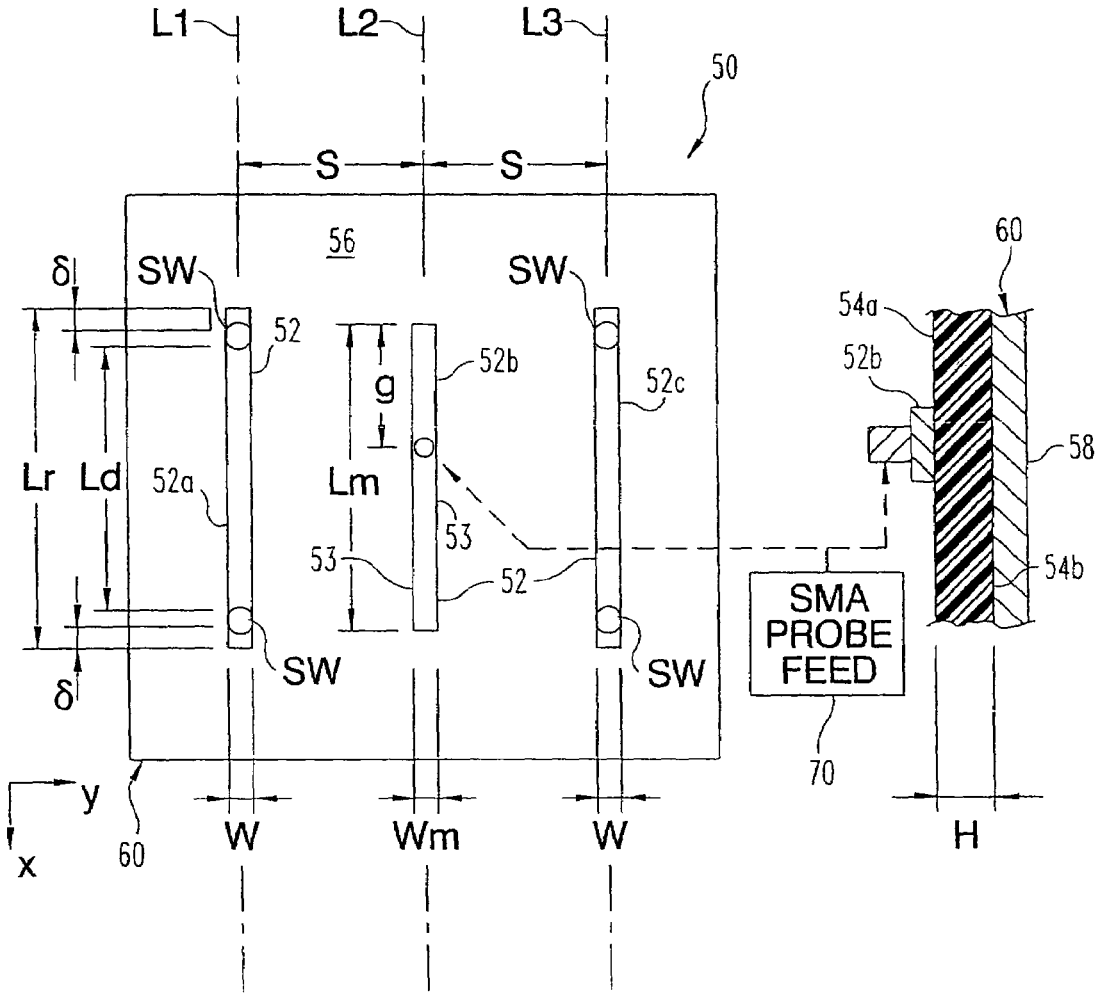
FIG. 2 is a partial, diagrammatic plan view and a comparative partial, side sectional view of a microstrip antenna of a first type that was utilized for proof of concept.

FIG. 2 illustrates one form of antenna 40 as microstrip antenna 50. Antenna 50 includes three electrically conductive elements 52*a*, 52*b*, and 52*c* (collectively designated elements 52) of a microstrip type carried on one side 54*a* of a dielectric layer 56 with a finite ground plane 58 carried on an opposing side 54*b* of dielectric layer 56. In the depicted arrangement, dielectric layer 56 is in the form of a generally planar substrate 60 comprised of a suitable dielectric material with electrically conductive finite ground plane 58 in the form of a metallic layer. The elements 52*a*, 52*b*, and 52*c* are each elongate microstrips with respective longitudinal axes L1, L2, and L3 that are approximately parallel to one another. Correspondingly, elements 52*a* and 52*c* each extend along a longitudinal side 53 of element 52*b*. Elements 52 and substrate 60 are arranged such that an imaginary plane intersects at least some portion of each of elements 52 while being parallel to the longitudinal axes L1, L2, and L3. It should be appreciated that this relationship can result even if there is a certain degree of nonplanarity in substrate 60 and/or elements 52. In other embodiments, substrate 60 may not be approximately planar, may be curved, and/or may be configured as a flex-print or flexible circuitry type—just to name a few possibilities.

The central element (the active signal element) 52*b* is driven by a communication signal via an SMA probe 70. Probe 70 is schematically shown in FIG. 2. Antenna 50 is linearly polarized, with the x-y plane as the E-plane, and the y-z plane as the H-plane. SMA probe 70 provides the drive signal, which can be moved along the center microstrip line (the x axis) of element 52*b* to match impedance as needed. The other two elements 52*a* and 52*c* (the parasitic adjustment elements), positioned on opposite sides of the signal element (element 52*b*), each include a pair of mechanical switches SW that were provided as removable copper strips for experimental purposes; however, it should be understood that other types of switches can be used in other embodiments, including but not limited to the Micro-Electro-Mechanical System (MEMS) switch type, one or more PIN diodes (described further in connection with FIGS. 4-9), or the like.

Experiments with the copper strip form of switches SW were performed, verifying proof of concept. The dimensions for antenna 50 were selected in accordance with the following relationships: $L_m \approx \lambda_g/2$, $S \approx \lambda_0/4$, $L_r > L_m$, and $L_d < L_m$; where $\lambda_g$ is the signal wavelength in substrate 60 and $\lambda_0$ is the signal wavelength in free space.

Figure 3:
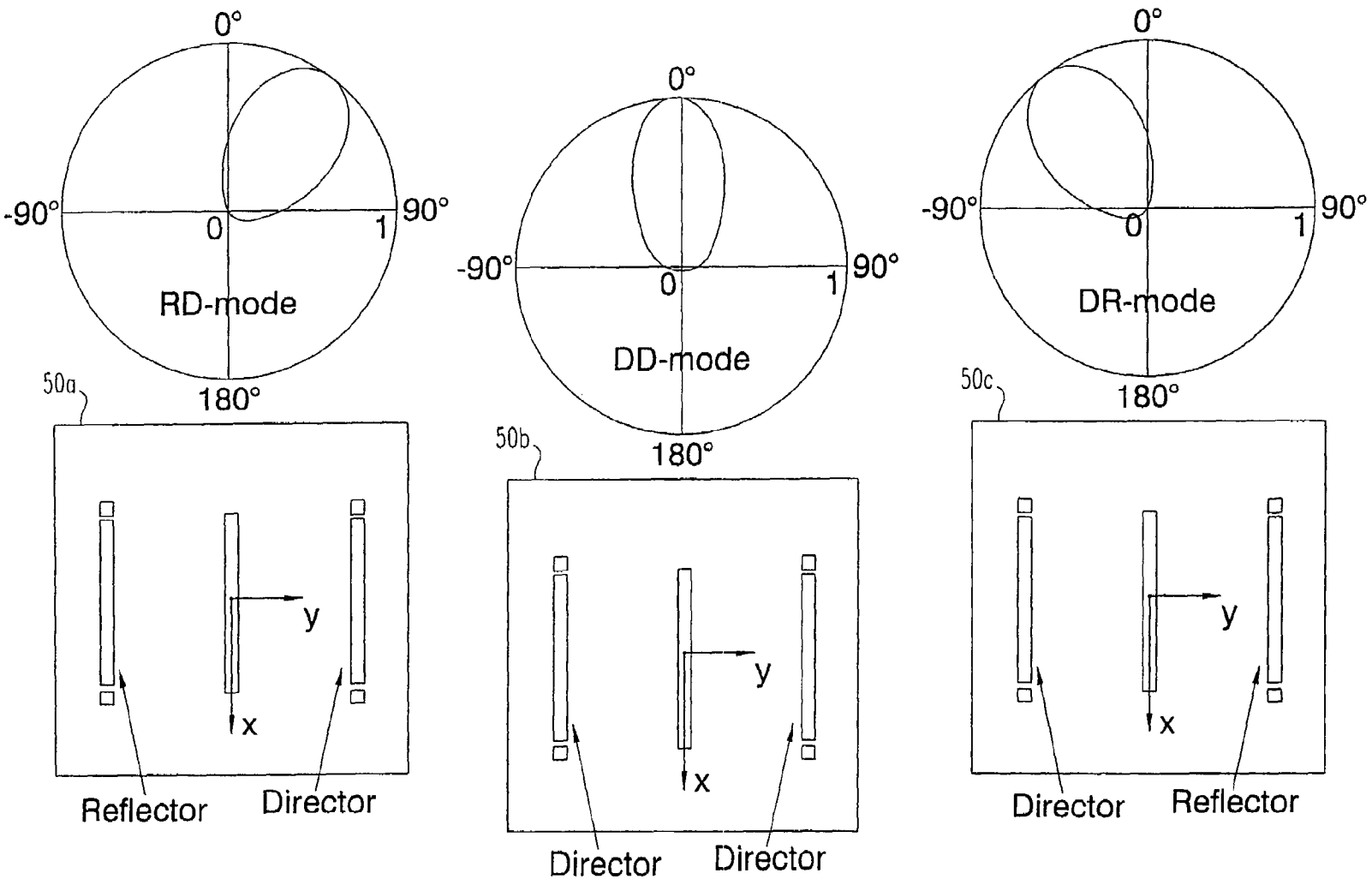
FIG. 3 are partial, diagrammatic views depicting three different configurations of the antenna of FIG. 2 and three different corresponding radiation patterns in the H-plane.

Antenna 50 includes four switches SW, each on one end of the outer microstrip lines (elements 52). By turning on/off switches SW, the radiation direction of antenna 50 can be reconfigured to any of three directions while the matching frequency bandwidth remains stable. Referring additionally to FIG. 3, comparative diagrams of the different radiation patterns designated as RD-mode, DD-mode, and DR-mode are illustrated in the upper part of the view with the respective antenna switch configurations of antenna 50 shown in the lower part of the view. These different antenna configurations are designated as RD configuration 50*a*, DD configuration 50*b*, and DR configuration 50*c*.

The RD, DD, and DR labels correspond to different Reflector (R) and Director (D) configurations of the outer two elements 52*a* and 52*c*. In the RD-mode, the radiation pattern is tilted to the right relative to the DD-mode, and in the DR-mode, the radiation pattern is tilted to the left relative to the DD-mode. Correspondingly, for the RD configuration 50*a*, the leftmost element 52*a* has both switches SW closed to function as a reflector R and the rightmost element 52*c* has both switches SW open to function as a director D. For the DD configuration 50*b*, all switches SW are open, operating each of the elements 52*a* and 52*c* on either side of the central signal element 52*b* as a director D. For the DR configuration 50*c*, the switch configurations are opposite those of configuration 50*a*, such that the leftmost element 52*a* becomes a director D and the rightmost element 52*b* becomes a reflector R. Correspondingly, by closing switches SW of a given one of the adjustment microstrip elements 52*a* and 52*c*, its length becomes effectively greater than the middle signal element 52*b* resulting in operation as a reflector R; while opening the switches SW of a given one of the adjustment microstrip elements 52*a* and 52*c* reduces its length to less than the middle signal element 52*b* resulting in operation as a director D.

Figure 4:
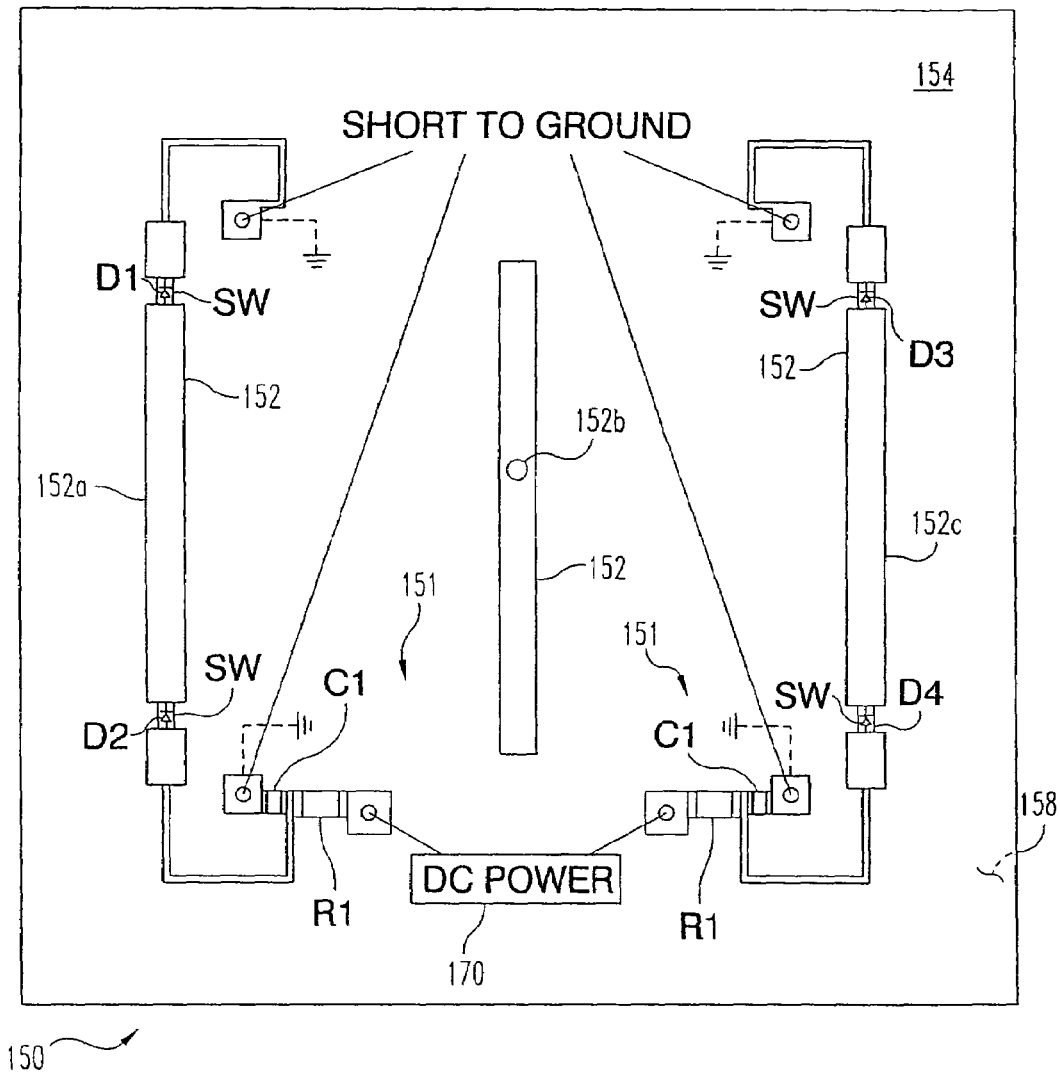
FIG. 4 is a partial, diagrammatic plan view of a microstrip antenna of a second type that was implemented in one experimental form with PIN diodes.

Referring to FIG. 4, another alternative form of antenna 40 is illustrated as microstrip antenna 150. Antenna 150 is configured generally the same as antenna 50, except that it specifically has been adapted to use PIN diodes D1, D2, D3, and D4 as switches SW with an appropriate bias network 151. Antenna 150 includes microstrip elements 152 carried on a substrate dielectric layer 154 opposite a finite ground plane 158. Reference numeral 158 is shown with a phantom leader line to represent that the ground plane is hidden in the plan view of FIG. 4. Elements 152 include parasitic, adjustable outer elements 152*a* and 152*c* positioned on either side of a central signal element 152*b*. In one experimental set-up Microsemi's PIN diode model MPP4203 were each used as a switch SW to adjust operation of elements 152*a* and 152*c*. For the depicted arrangement, a quarter wavelength high impedance microstrip line was added to each end of the outer elements of antenna 150. The geometry of the quarter wavelength microstrip line is selected to minimize its effect on the radiation pattern of antenna 150. Bias network 151 includes a Direct Current (DC) blocking capacitor C1 and a DC bias resistor R1. The electrical ground connections shown in FIG. 4 can be provided by electrically conductive vias to ground plane 158 through dielectric layer 154. DC bias voltage can be applied through wiring, electrically insulative via holes through dielectric layer 154 and ground plane 158, or in a different manner as would occur to one skilled in the art. Antenna 150 operates in the RD, DD, and DR modes. Table I shows the values of the physical parameters of antenna 150 designed at 3.75 GHz.

TABLE I

| $\epsilon_r$ | H | S | $W_m = W$ | $L_m$ | g | $L_d$ | $L_r$ | δ |
|---|---|---|---|---|---|---|---|---|
| 2.2 | 6.35 mm | 20 mm | 2 mm | 28.5 mm | 12 mm | 23.2 mm | 32 mm | 1.85 mm |

Figure 5:
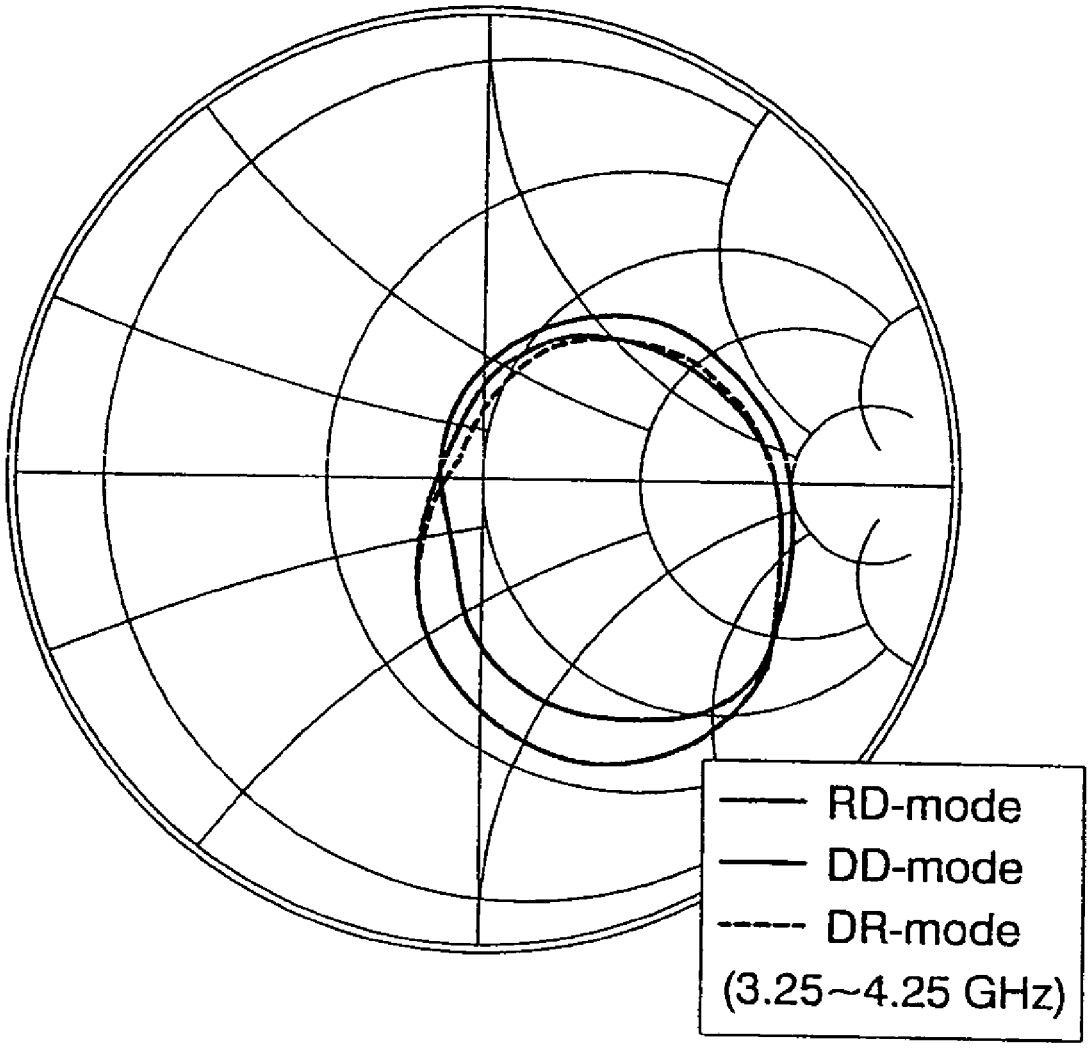
FIG. 5 is a graph of frequency response for three operating modes of the antenna shown in FIG. 4.
Figure 6:
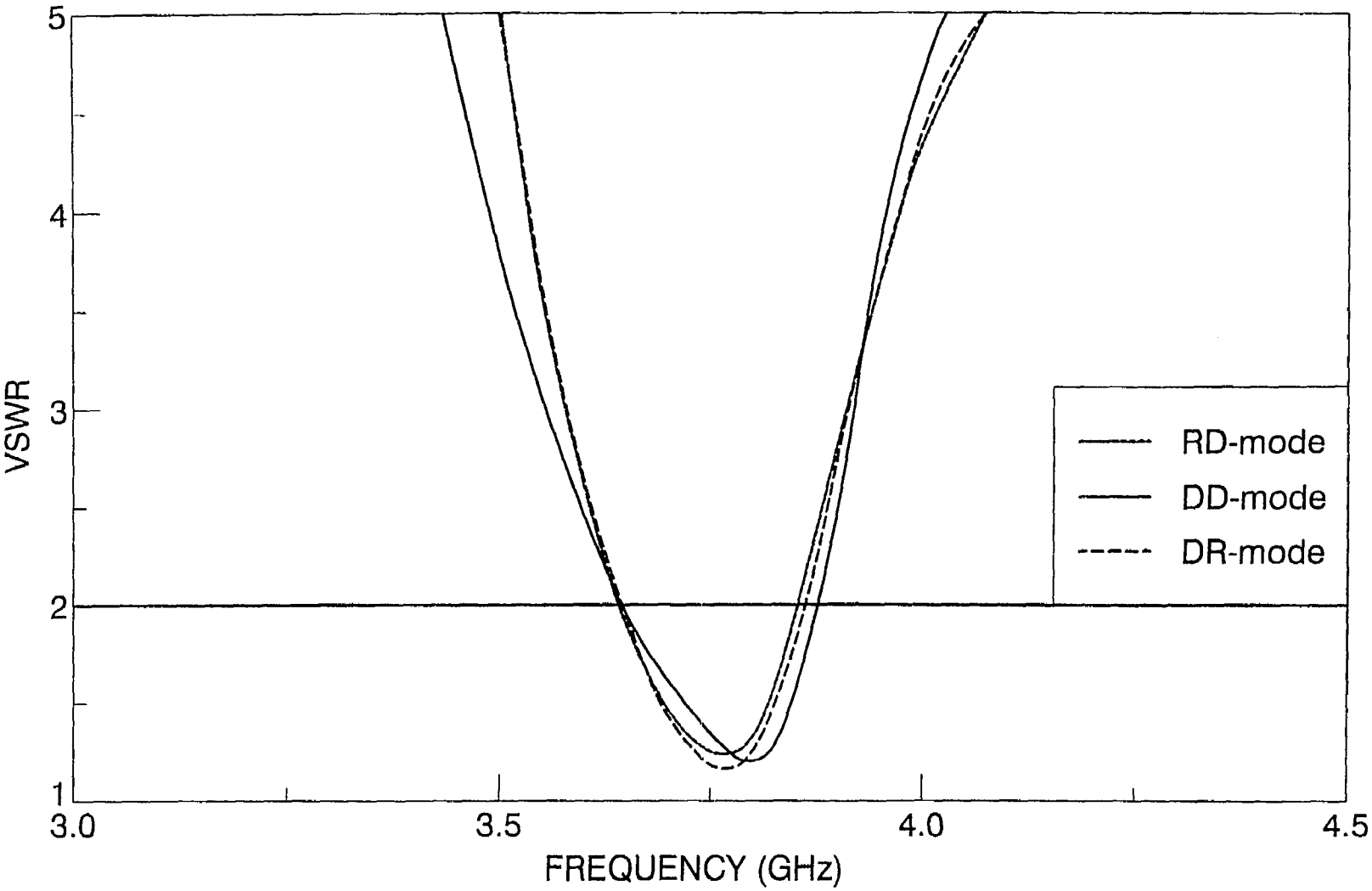
FIG. 6 is a graph of Voltage Standing-Wave Ratio (VSWR) versus frequency for the three operating modes of the antenna shown in FIG. 4.

In one arrangement, the bias voltage (DC power) 170 applied to the outer elements 152*a* and/or 152*c* is 12 volts to turn PIN diodes D1 and D2, and/or PIN diodes D3 and D4 on and 0 volt to turn PIN diodes D1 and D2 and/or PIN diodes D3 and D4 off. For this arrangement, the bias resistance (R1) was selected to be about 1000 Ω, and the DC-block capacitance (C1) was selected to be about 850 pF for the model MPP4203 implementation. The frequency response at 3.75 GHz and common 2:1 Voltage Standing-Wave Ratio (VSWR) bandwidth 3.64~3.85 GHz of antenna 150 are shown in FIG. 5 and FIG. 6, respectively, for an experimental form based on this arrangement.

Figure 7:
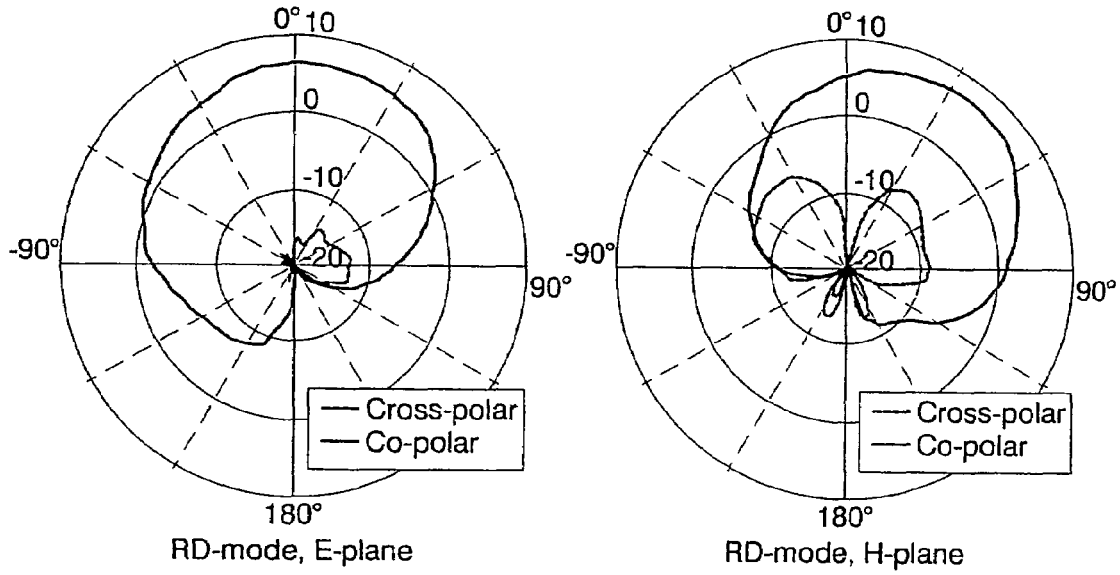
FIG. 7 depicts two graphs each showing radiation patterns for a first one of the operating modes of the FIG. 4 antenna in the E-plane and H-plane, respectively.
Figure 8:
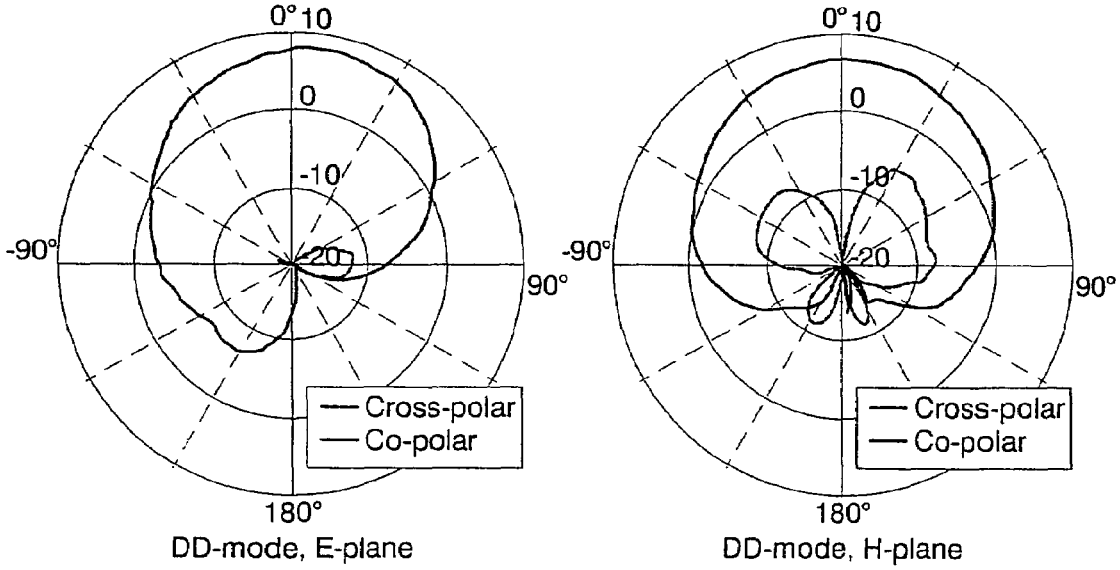
FIG. 8 depicts two graphs each showing radiation patterns for a second one of the operating modes of the FIG. 4 antenna in the E-plane and H-plane, respectively.
Figure 9:
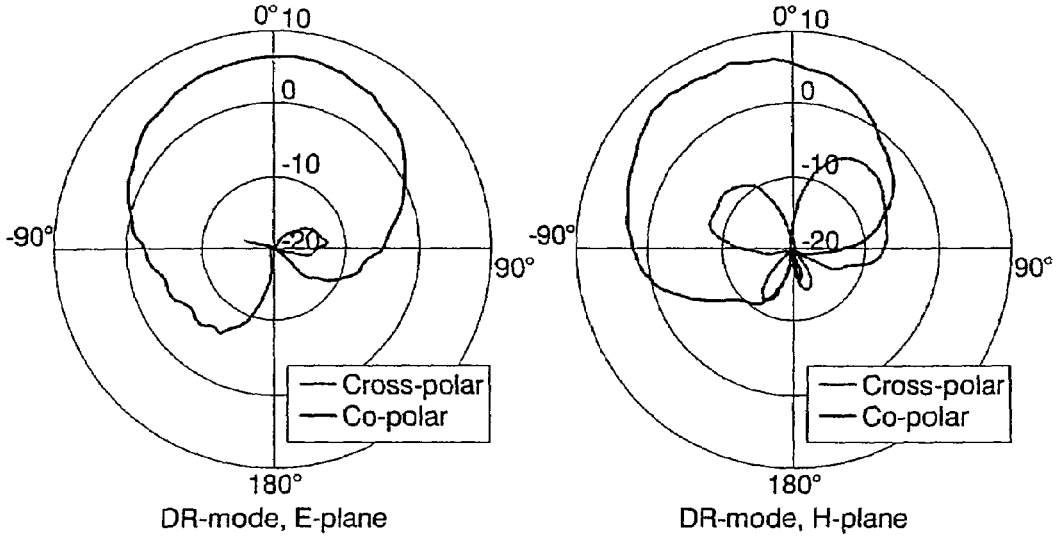
FIG. 9 depicts two graphs each showing radiation patterns for a third one of the operating modes of the FIG. 4 antenna in the E-plane and H-plane, respectively.

For antenna 150, FIG. 7 depicts experimentally determined RD-mode radiation patterns in the E-plane and the H-plane, respectively; FIG. 8 depicts experimentally determined DD-mode radiation patterns in the E-plane and the H-plane, respectively; and FIG. 9 depicts experimentally determined DR-mode radiation patterns in the E-plane and the H-plane, respectively. Correspondingly, the PIN diodes D1 and D2 of the left outer element 152*a* are on and the PIN diodes D3 and D4 of right outer element 152*c* are off for the RD-mode, all PIN diodes D1, D2, D3, and D4 are off for the DD-mode, and the PIN diode on/off state for the DR-mode is the inverse of the RD-mode. For the RD-mode of antenna 150, the radiation pattern tilts about +30 degrees in the H-plane relative to the H-plane of the DD-mode. For the DR-mode of antenna 150, the radiation pattern tilts about −30 degrees in the H-plane relative to the H-plane of the DD-mode. It should be appreciated that the PIN diode arrangement can be readily integrated with antenna control circuitry 26 described in connection with FIG. 1.

Figure 10:
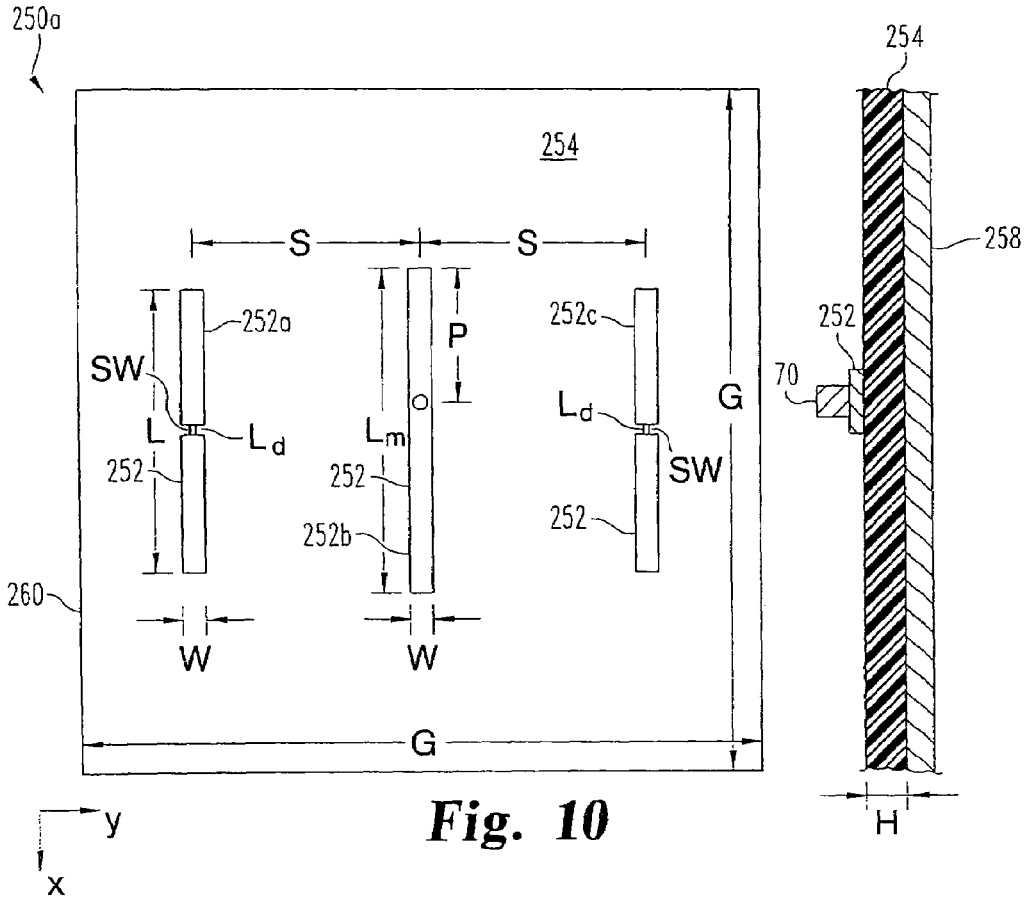
FIG. 10 is a partial, diagrammatic plan view and a comparative partial, side sectional view of a microstrip antenna corresponding to a third type.

FIG. 10 depicts another form of reconfigurable antenna 40 as microstrip antenna 250*a*; where like reference numerals refer to like features previously described. Antenna 250*a* is configured with three approximately parallel microstrip elements 252 on a dielectric substrate 260 including dielectric layer 254 with an opposing finite ground plane layer 258 generally like antennas 50 and 150; however, the relative dimensioning and switching aspects differ. Specifically, antenna 250*a* includes two adjustable components Ld that are each approximately centered along the length of a respective one of the outer microstrip elements 252*a* and 252*c*. The adjustable component Ld is in the form of a switch SW. Each component Ld is arranged to change the effective length of the corresponding parasitic element 252*a* or 252*c* relative to the middle signal element 252*b* by way of changing the state of the respective switch SW. In other embodiments, either of components Ld can be of another arrangement that alternatively or additionally includes tuning one or more variable reactive (inductive and/or capacitive) components, comparable to the effective length change resulting from adjusting the switches SW of antenna 50 and 150. Subsequently described embodiments provide a few examples structured with adjustable reactive elements.

For antenna 250*a*, components Ld are each in the form of a switch SW that can be of any suitable type. In one prototype arrangement, copper strips are used for antenna 250*a* as described in connection with antenna 50. In another form, PIN diodes are used to provide switches for antenna 250*a*. By turning on/off the antenna 250*a* switches, the radiation direction of antenna 250*a* is reconfigured among three different modes (i.e. directions) while the matching frequency bandwidth remains generally stable. The second row of Table II provides selected parameters of antenna 250*a* working at 3.7 GHz, as follows:

TABLE II

| | $\epsilon_r$ | H (mm) | G (mm) | $L_m$ (mm) | p (mm) | L (mm) | W (mm) | s (mm) |
|---|---|---|---|---|---|---|---|---|
| Antenna 250a | 2.2 | 6.35 | 60 | 28.5 | 11.75 | 26 | 2 | 20 |
| Antenna 250b | 2.2 | 6.35 | 60 | 28.5 | 11.75 | 27 | 2 | 20 |
| Antenna 250c | 2.2 | 6.35 | 60 | 28.3 | 12.2 | 28.9 | 2 | 20 |

Figure 11:
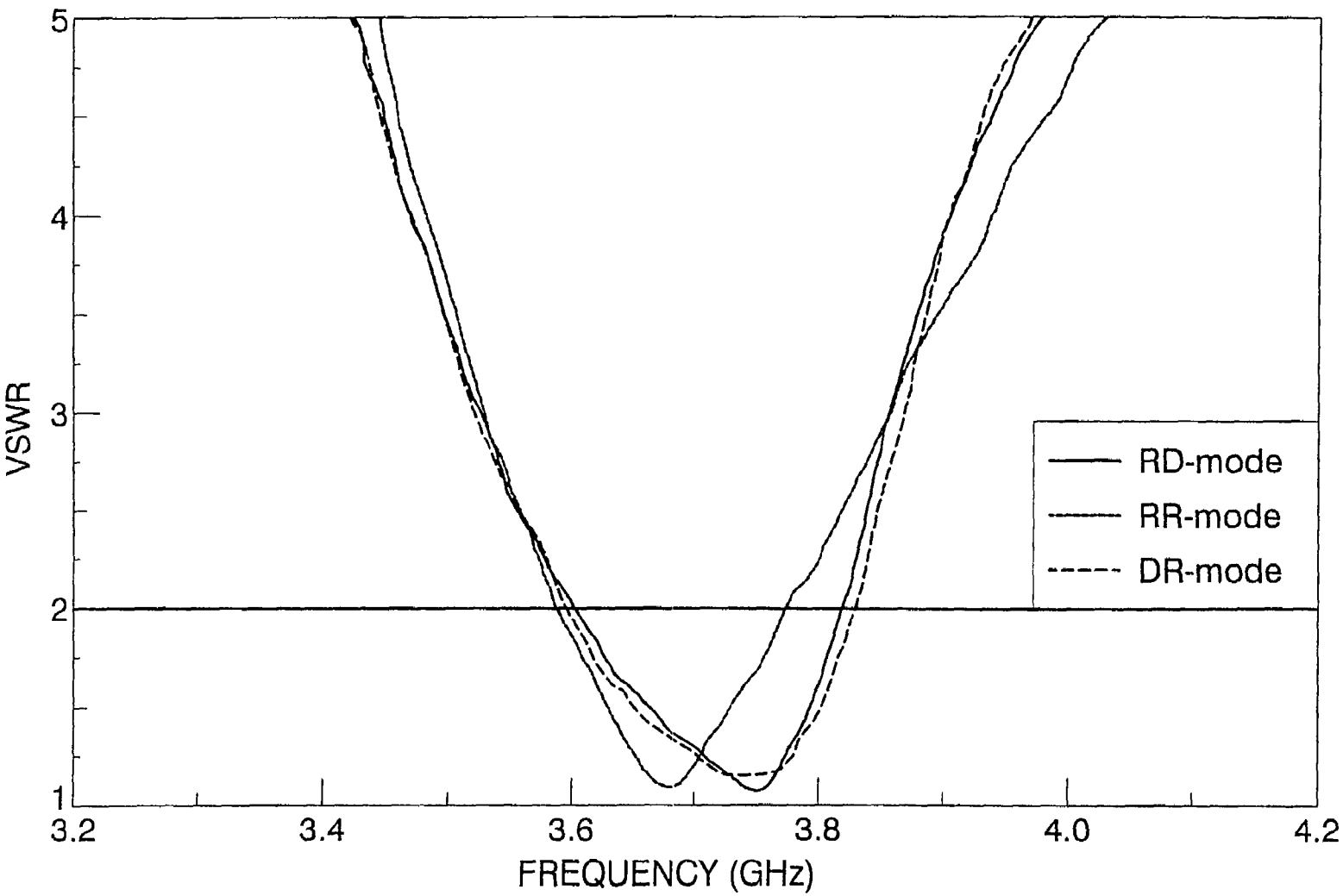
FIG. 11 is a graph of VSWR versus frequency for three operating modes for the third type of the antenna shown in FIG. 10.
Figure 12:
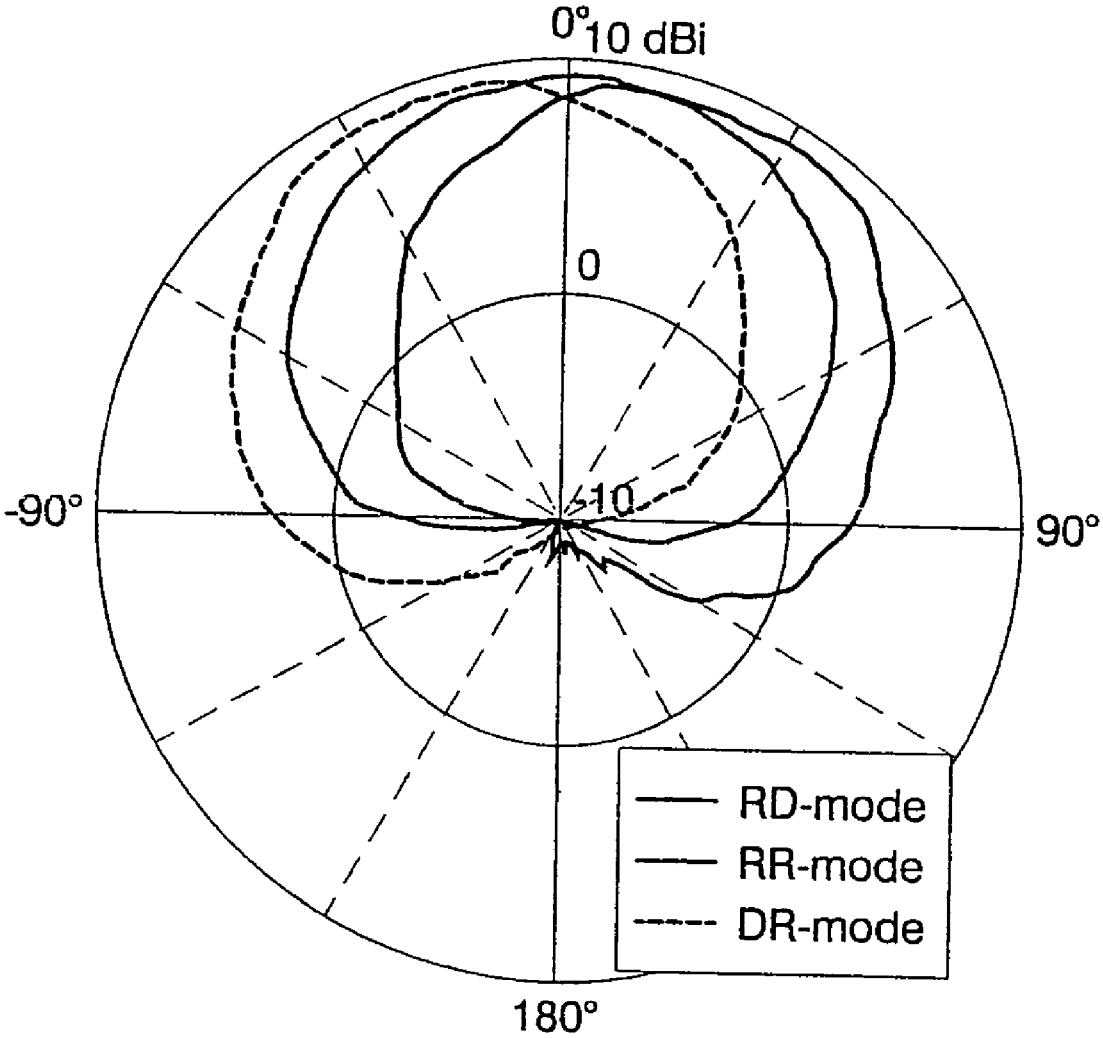
FIG. 12 is a graph showing radiation patterns for three H-plane operating modes of the third type of the antenna shown in FIG. 10.

FIG. 11 illustrates a shared VSWR Bandwidth for antenna 250*a* of 3.598~3.778 GHz. FIG. 12 depicts the different radiation pattern configurations in the H-plane for antenna 250*a* measured at 3.68 GHz. Compared to antenna 50 and 150, the arrangement of antenna 250*a* provides smaller tilt angles of about +/−25 degrees. When the switch SW of a parasitic element 252*a* or 252*c* of antenna 250*a* is closed, it performs as a director D. When this switch SW is open, the parasitic microstrip element 252*a* or 252*c* is effectively separated into two parts, typically resulting in negligible effects on radiation and impedance because the induced current is very weak. Correspondingly, with an open switch SW, the parasitic element 252*a* or 252*b* of antenna 250*a* does not generally behave as a reflector—unlike the differently positioned switches of antenna 50 and 150. Given the absence of a reflector element, a smaller tilt angle range is believed to result for antenna 250*a* compared to antennas 50 and 150; however, the RD, DD, and DR terminology is still used to preserve clarity and consistency.

Figure 13:
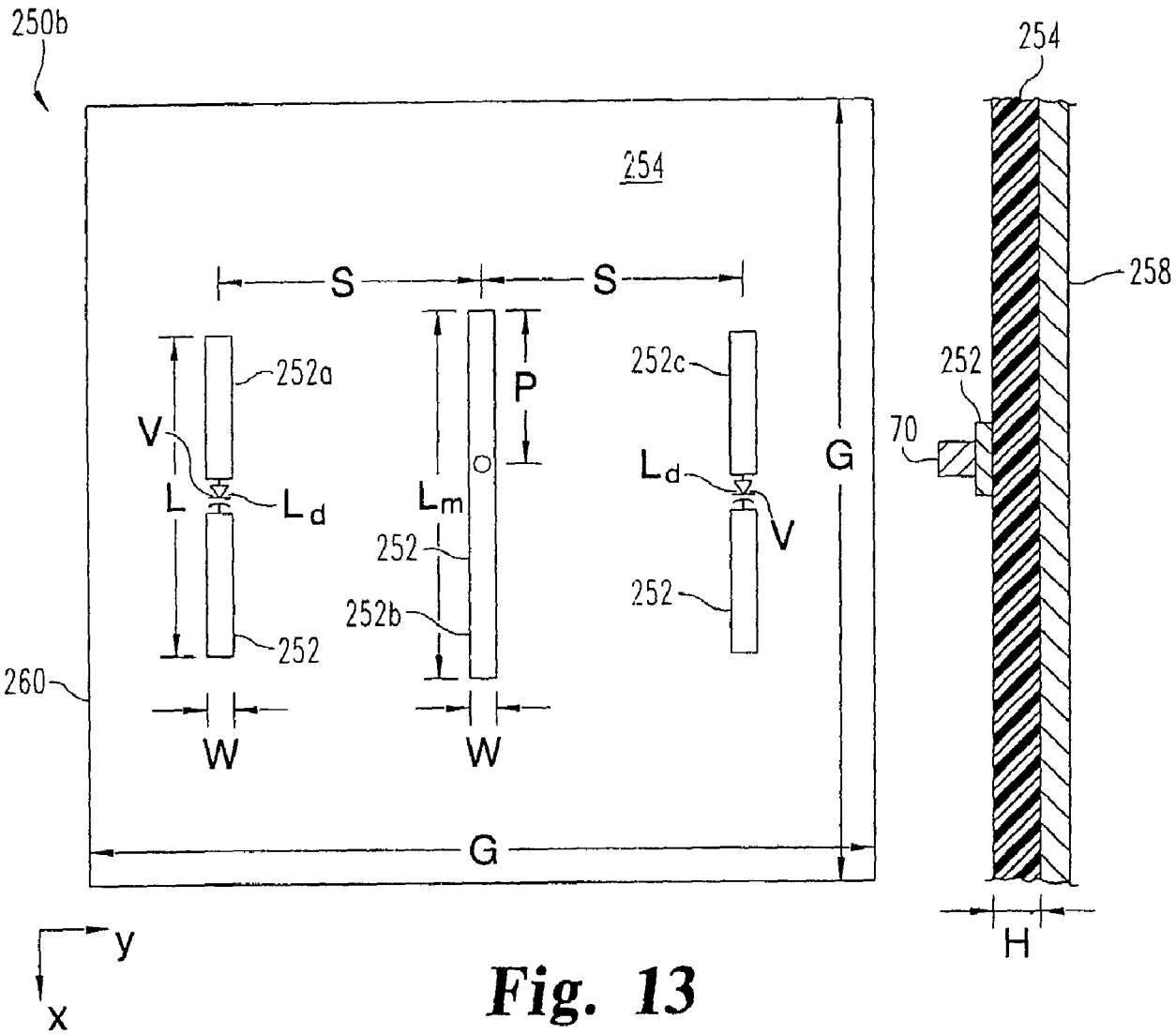
FIG. 13 is a partial, diagrammatic plan view and a comparative partial, side sectional view of a fourth type of microstrip antenna.
Figure 14:
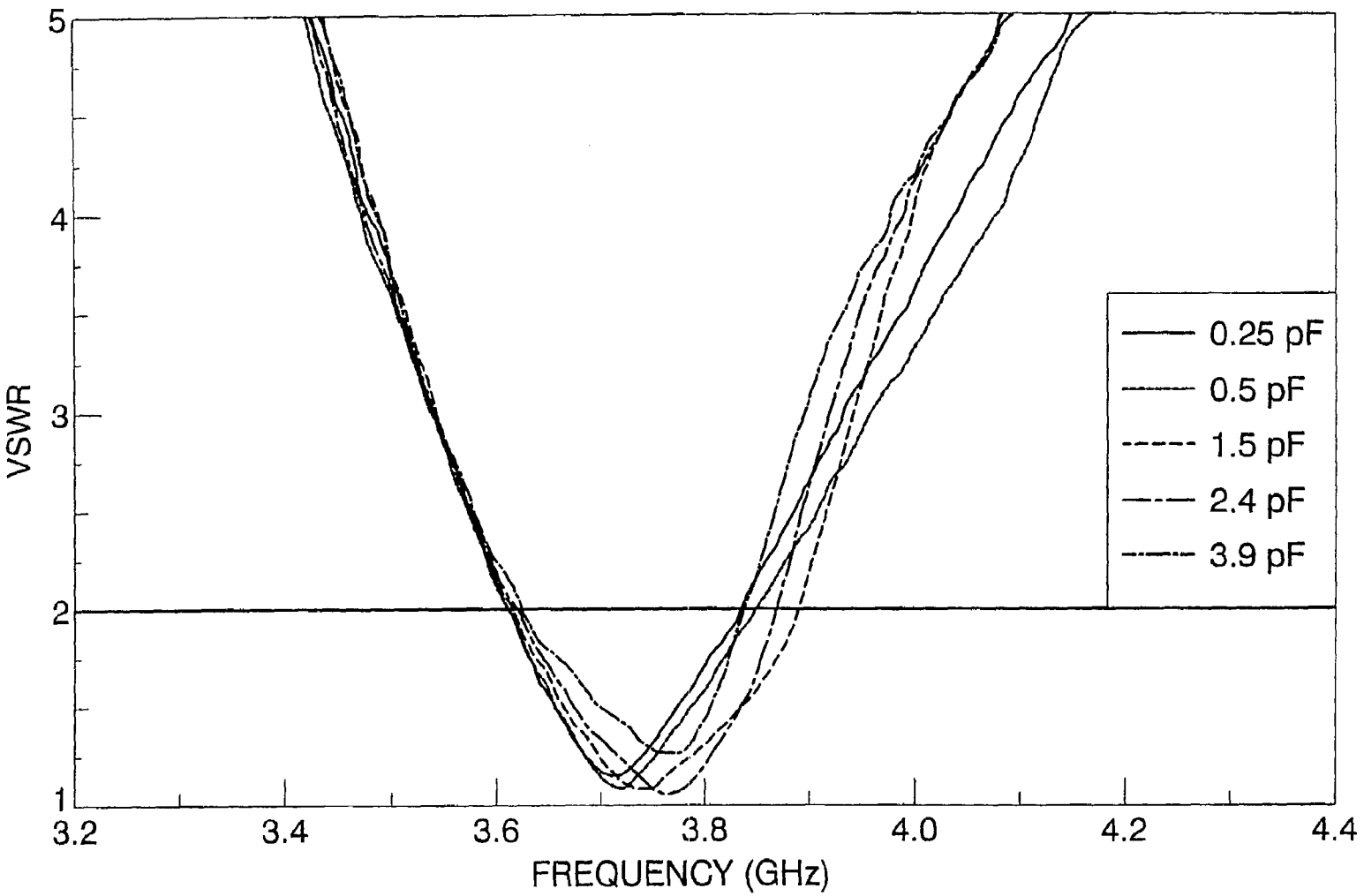
FIG. 14 is a graph of VSWR versus frequency for the fourth type of antenna shown in FIG. 13.
Figure 15:
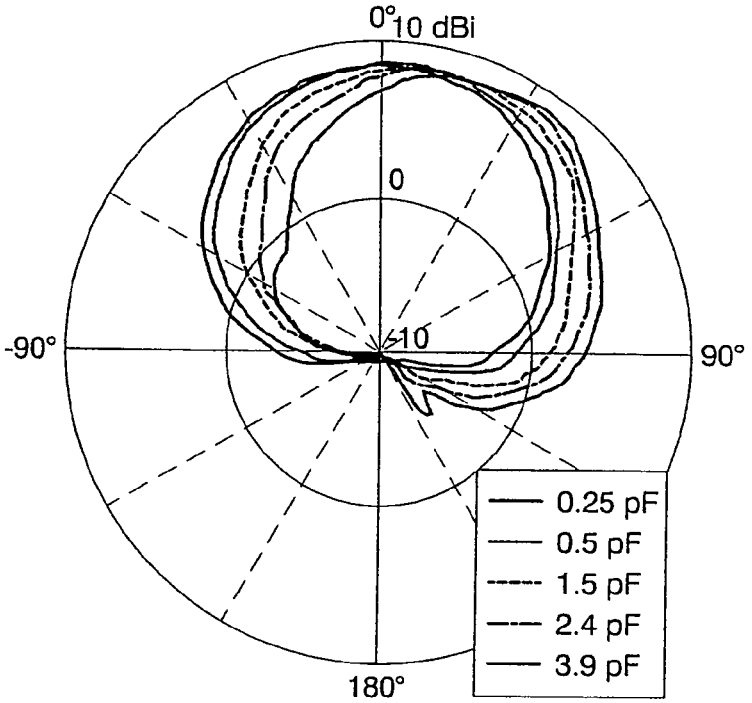
FIG. 15 is a graph showing H-plane radiation patterns for the fourth type of antenna shown in FIG. 13.
Figure 16:
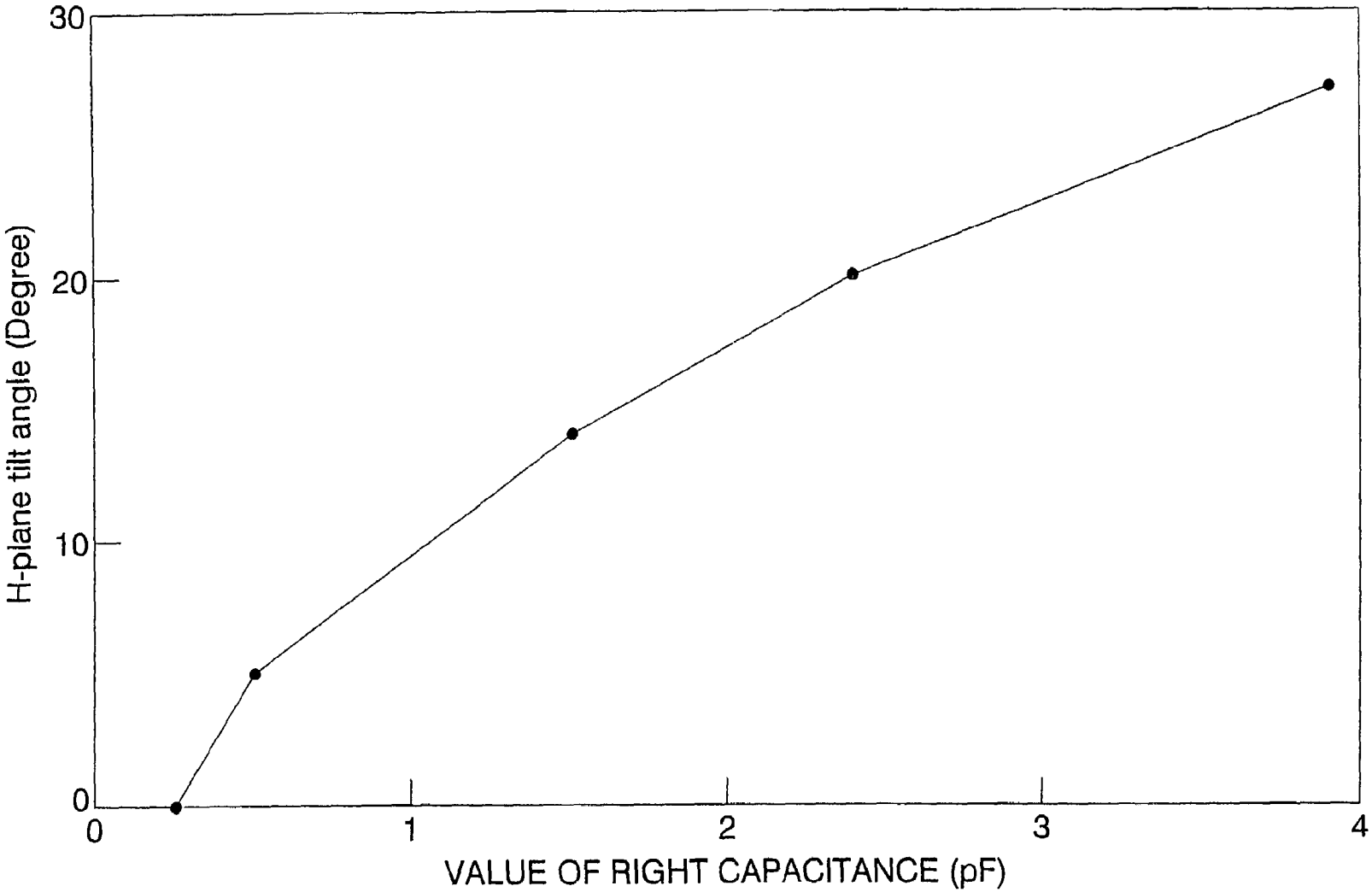
FIG. 16 is a graph depicting radiation pattern tilt angle in the H-plane versus varying capacitance for the fourth type of antenna shown in FIG. 13.

FIG. 13 illustrates microstrip antenna 250*b*; where like reference numerals refer to like features previously described in connection with FIG. 10. Antenna 250*b* is an arrangement with the adjustable components Ld each being a varactor V instead of a switch SW as in antenna 250*a* and the length of the outer elements 252*a* and 252*c* each being different from antenna 250*a*, as shown in Table II. One experimental form of antenna 250*b* was implemented with chip capacitors of different values instead of a varactor V to provide proof of concept. FIG. 14 depicts the shared VSWR bandwidth: 3.62~3.836 GHz; and FIG. 15 depicts different radiation pattern tilt angles in the H-plane for different capacitance values of one experimental form of antenna 250*b* designed for a frequency of 3.7 GHz. For this form, tilt angle varied from about 0° to about +27° when the capacitance of the right outer element 252*c* is increased from about 0.25 pF to about 3.9 pF and the left outer element 252*a* capacitance is set at about 0.25 pF (the radiation patterns in the E-plane are not shown since they are broadside for all modes). FIG. 15 depicts selected radiation patterns corresponding to the indicated capacitance values over this tilt angle range for 3.72 GHz operation of antenna 250*b*. FIG. 16 depicts H-plane tilt angle versus capacitance for component Ld of the right outer microstrip element 252*c* for antenna 250*b*. Because of the symmetry of the structure, the radiation pattern in H-plane is expected to scan from 0° to −27° when the left capacitance is increased from 0.25 pF to 3.9 pF and the right capacitance is set at 0.25 pF. Thus, by tuning the bias voltage of each varactor V, the radiation direction of antenna 250*b* can be scanned between about −27° to about +27° in the H-plane.

Figure 17:
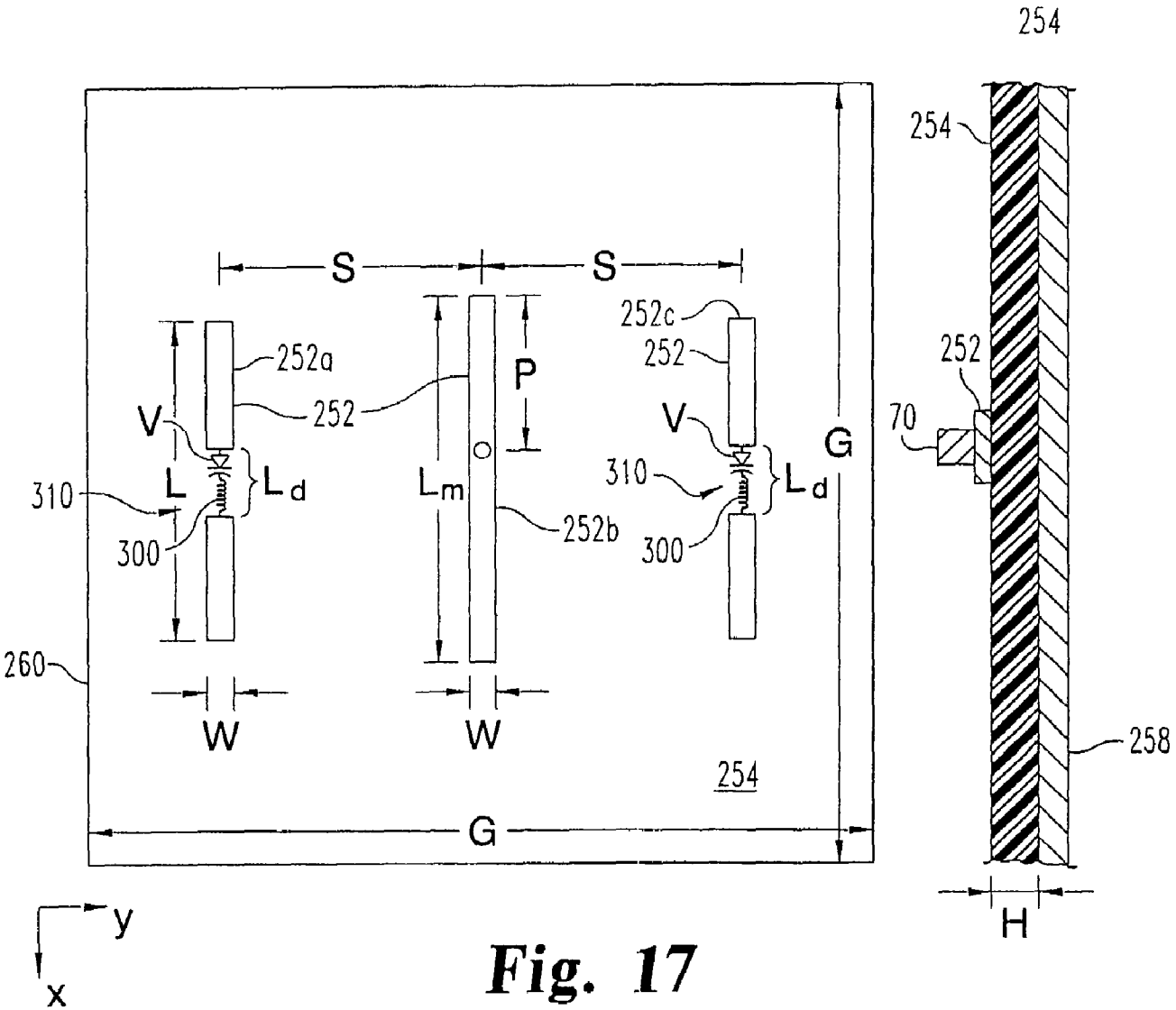
FIG. 17 is a partial, diagrammatic plan view and a comparative side, sectional view of a fifth type of microstrip antenna.

FIG. 17 illustrates microstrip antenna 250*c*; where like reference numerals refer to like features previously described in connection with FIG. 10. Antenna 250*c* is configured like antenna 250*b* with an inductor 300 placed in series with each of varactor V. Also, the length of the outer microstrip lines of antenna 250*c* differ from those of antenna 250*a* and antenna 250*b* as shown in Table II. Table II lists the physical parameters of antenna 250*c* designed for a nominal frequency of 3.7 GHz. The inductor 300 and varactor V series circuit 310 is arranged to selectively resonate at the operating frequency of antenna 250*c*. For a given parasitic element 252*a* or 252*c*, when the value of the varactor V is tuned such that resonance with inductor 300 occurs, then this element 252*a* or 252*c* functions as a reflector R. In contrast, when varactor V is tuned to be smaller than the resonant value, then the respective element 252*a* or 252*c* is capacitive, such that it functions as a director D.

Figure 19:
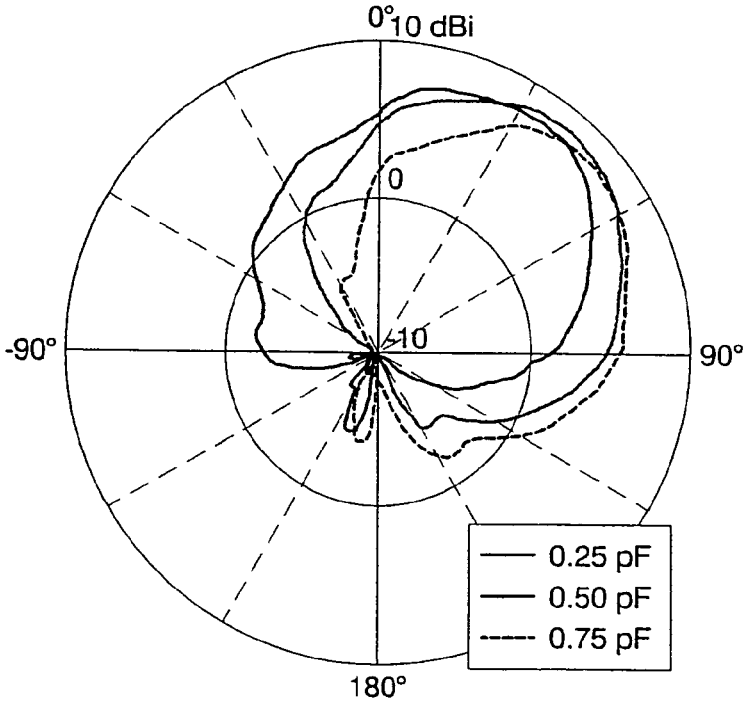
FIG. 19 is a graph showing H-plane radiation patterns for the fifth type of antenna shown in FIG. 10.
Figure 18:
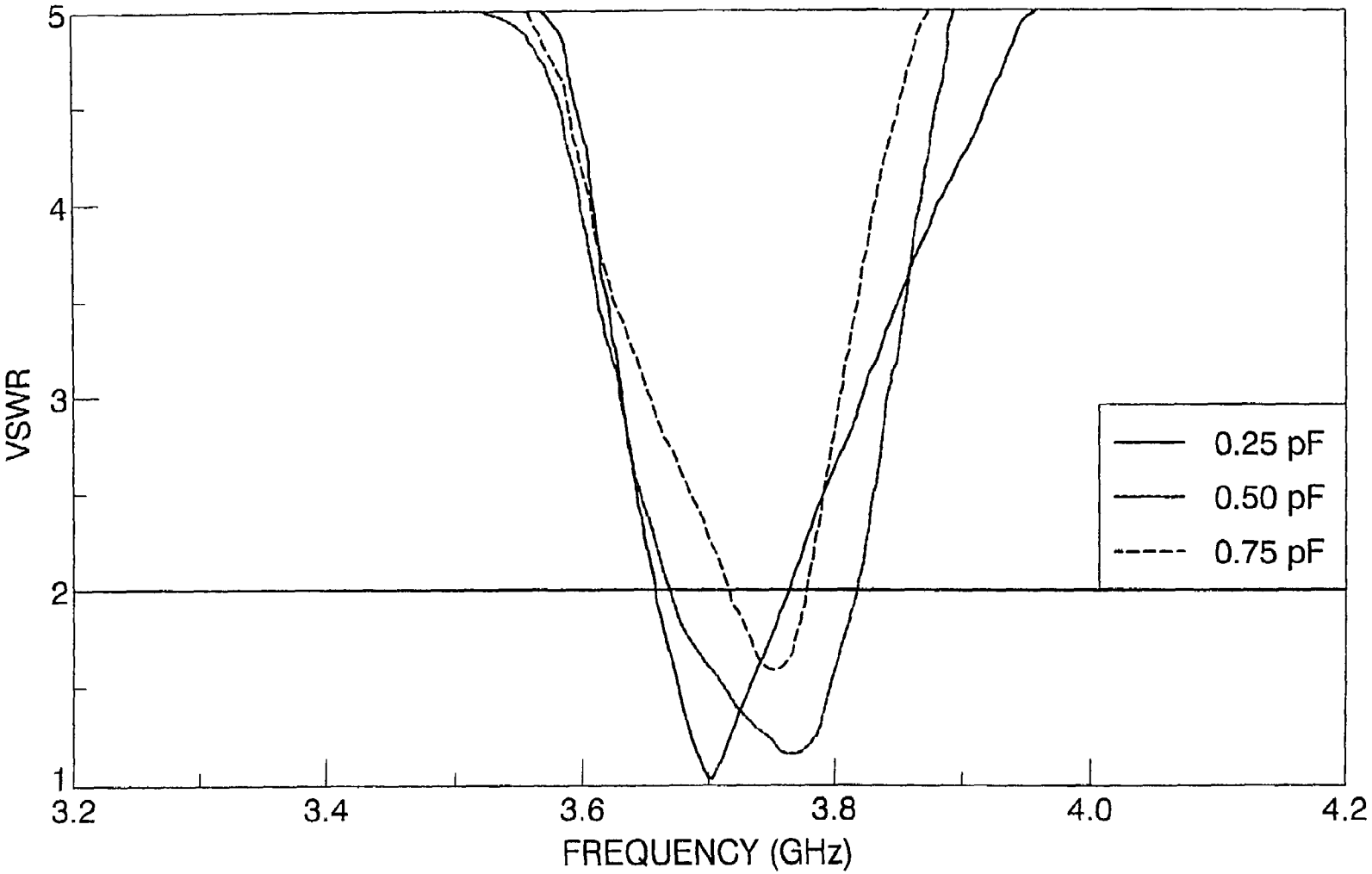
FIG. 18 is a graph of VSWR versus frequency for several operating modes of a fifth type of antenna.
Figure 20:
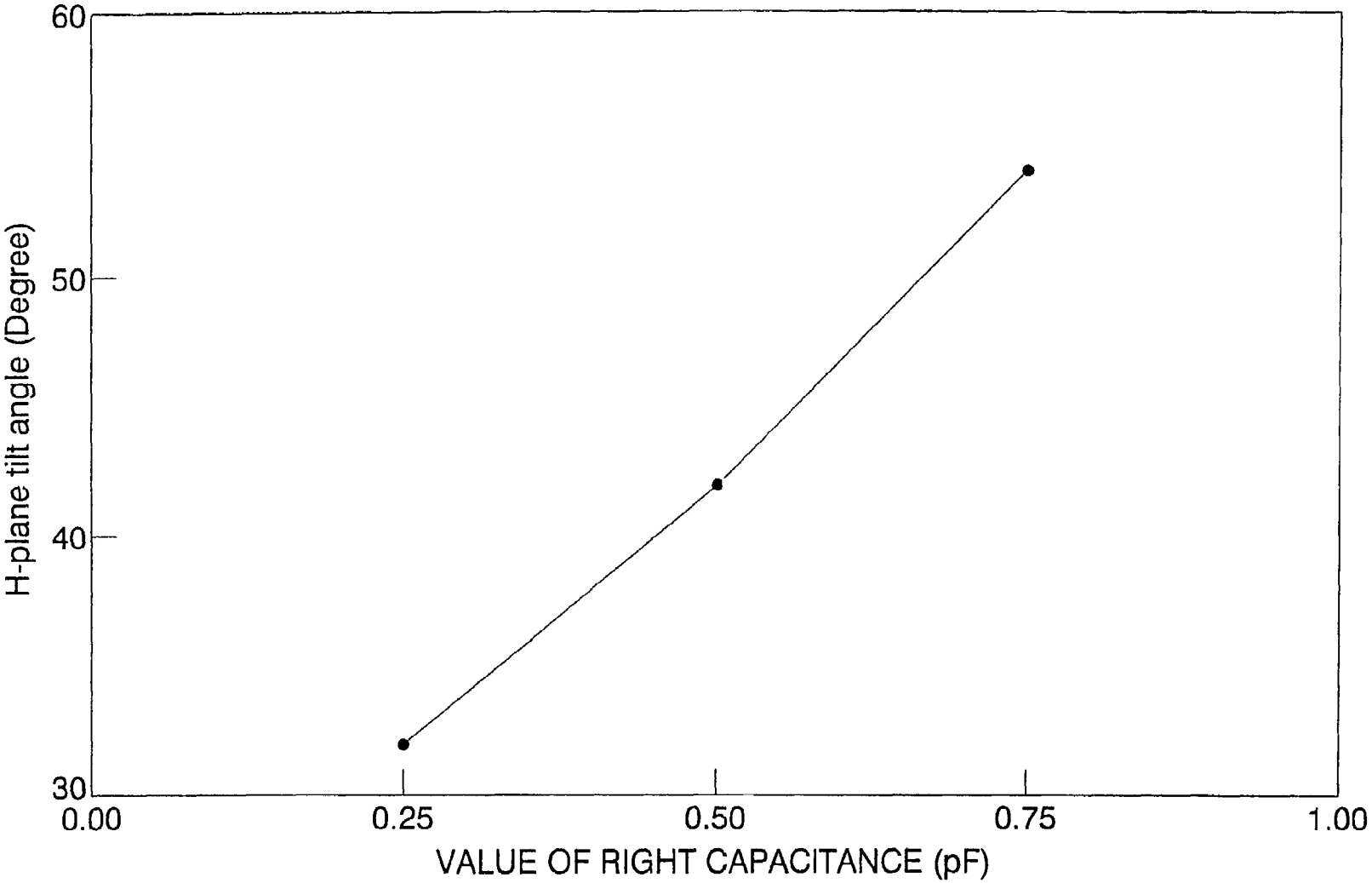
FIG. 20 is a graph depicting radiation pattern tilt angle in the H-plane versus varying capacitance for the fifth type of antenna.

FIG. 18 shows shared VSWR bandwidth: 3.71~3.76 GHz for antenna 250*c*. FIG. 19 shows H-plane radiation pattern variation for three different capacitance values for the varacter V of the right outer element 252*c* of antenna 250*c*. FIG. 20 shows H-plane tilt angle versus capacitance for antenna 250*c*.

As shown in FIG. 18, the H-plane tilt angle varies from +32°~+54° as the right outer element 252*c* capacitance of component Ld is increased from 0.25 pF to 0.75 pF, with the left outer element 252*a* capacitance of component Ld set at 1.75 pF, and the inductances 300 of both outer elements 252*a* and 252*c* set at 1 nH (the radiation patterns in the E-plane are not shown since they are broadside for all modes). Due to the symmetry of the antenna's geometry, the H-plane pattern is expected to scan from −32° to −54° if the right outer element 252*c* capacitance of component Ld is set to 1.75 pF and the left outer element 252*a* capacitance of component Ld is increased from 0.25 pF to 0.75 pF for an inductance value of 1 nH for each component Ld. Thus, antenna 250*c* provides a reconfigurable radiation pattern by scanning from −32° to −54° and from +32° to +54° in the H-plane when tuning the bias voltage of the varactor V.

While experimental examples of antennas described herein were based on an operating frequency in the vicinity of 3.75 GigaHertz (GHz), it should be understood that such antennas can be designed to work at many other frequencies with appropriate scaling of the length of the antenna elements (such as a central radiating element) and the thickness of the substrate. Accordingly, with increasing operating frequency, antenna element size requirements diminish, making the antenna more suitable to integration with switches and control circuits on wafers. In accordance with the present invention, an antenna can be provided that has one stable tilt/split radiation pattern, multiple switchable radiation patterns, or different scannable patterns for various scan ranges. Among the parameters that can be adjusted to provide differently performing antennas are the substrate permittivity and thickness, microstrip line width and length, the number of microstrip lines, the number and position of microstrip switches, the selected value or range of values offered by reactive components (varactors, inductors, capacitors, etc.) that are coupled to one or more microstrips, or the like. Additionally or alternatively, the number of microstrips for a given implementation may be more of fewer, the width or length of the microstrip elements of a given antenna may vary from one to the next, the degree of parallelism between multiple microstrip elements of an antenna may vary, and/or shaping of the microstrips may vary. In one nonlimiting example, increasing the microstrip width of the center microstrip in a three microstrip element arrangement expands the frequency bandwidth, and adjusting width of all microstrip lines changes the radiation pattern title angle of the arrangement. In another alternative, only two elements are utilized.

It should be appreciated that the reconfigurable antennas of the present application can be designed to work at different frequencies by choosing the length of the middle element and/or the permittivity of the substrate. By changing the width and/or length of the microstrip lines, the radiation direction can be tuned. Based on these concepts, an antenna with switchable and/or variable radiation patterns in the H-plane can be determined through proper selection of physical parameters such as substrate permittivity and thickness, microstrip line width and length, the number of microstrip lines, and number/application of switches, fixed or variable capacitors, and/or fixed or variable inductors, to name just a few possibilities. In one alternative embodiment, multiple fixed value capacitors and/or inductors are provided that are coupled to switching circuitry operable to provide any of a number of different selectable fixed radiation patterns in response to control circuitry. Furthermore, it should be understood that other embodiments may contain more or fewer microstrip elements, the adjustment microstrip element(s) of a given antenna may not be symmetric relative to the signal element, and/or the adjustment microstrip elements may each include different fixed or adjustable components to provide a desired radiation pattern shape, variability, or the like—to name just a few variations. In some applications, the preferred microstrip element has a length-to-width aspect ratio of at least 2. In a more preferred form of these applications, this aspect ratio is equal to or greater than 5. In an even more preferred form of these applications, this aspect ratio is equal to or greater than 10.

It should be further understood that by switching/scanning the radiation pattern of the antenna, the transmitter/receiver of the wireless communication device can be configured track one or more objectives, avoid jamming, and/or reduce noise in many applications. Moreover, multiple path interference potentially can be reduced. Alternatively or additionally, antennas of the present application can be used to form phased arrays, and/or can be used in MIMO (multiple-Input multiple-output) systems to achieve multiple transmit/receive channels. Having pattern reconfigurability provides more possible configurations to potentially increase wireless system throughput. The geometry and planarity of the proposed antennas provides a profile that can be conformal, and typically can be readily incorporated into the RF front end of standard commercial wireless packages.

Many other embodiments are also envisioned. For example, a system includes a reconfigurable antenna with a dielectric layer having a first side opposite a second side. The first side carries a signal element and two parasitic elements and the second side carries a electrical ground layer. The parasitic elements each extend along opposing longitudinal sides of the signal element and are spaced apart therefrom. The parasitic elements each include a respective variable reactive component operatively coupled between two electrically conductive portions. The system further comprises means for generating an electromagnetic signal with the signal element in response to a corresponding electrical drive signal and means for controlling the respective component of a first one of the parasitic elements and the respective component of a second one of the parasitic elements to change a radiation pattern of the antenna from a first configuration to a second configuration. In one form, the system includes a number of reconfigurable antennas and means for operating the antenna in a MIMO configuration and/or in a phased array configuration. Alternatively or additionally, the respective component of each parasitic element is a varactor and/or the parasitic elements each include a respective inductor.

In another example, an apparatus includes a wireless communication device. This device includes communication signal processing circuitry, antenna control circuitry, and a reconfigurable antenna. This antenna includes a multiple element arrangement carried on one side of a dielectric layer and an electrical ground layer carried on another side of the dielectric layer. This arrangement includes an electrically-conductive signal element operatively coupled to the communication signal processing circuitry to radiate an electromagnetic signal in response to application of a corresponding electrical signal. Also included in the arrangement is a first electrically conductive parasitic element extending along one longitudinal side of the signal element in a spaced apart relationship. The parasite element includes an adjustable component operatively coupled to the antenna control circuitry. This component is operatively coupled between two electrically conductive portions of the parasitic element and is responsive to the antenna control circuitry to change radiation pattern direction of the antenna.

Still another example is directed to an antenna device that includes a dielectric layer with a first side opposing a second side, an electrical ground layer carried on the first side of the dielectric layer, and an antenna arrangement carried on the second side of the dielectric layer. This arrangement includes two parasitic microstrip elements and a microstrip signal element. The signal element is structured to radiate an electromagnetic communication signal in response to application of a corresponding electrical communication signal. The parasitic antenna elements extend along opposing longitudinal sides of the signal element and are each spaced apart therefrom. The parasitic antenna elements each include an adjustable component operatively connected between two microstrips. This adjustable component is structured to selectively adjust effective operating length of a respective one of the parasitic antenna elements to change a maximum radiation direction of the antenna device. In one further embodiment, a system includes two or more of these antenna devices arranged in a MIMO communication platform and/or in a phased array configuration.

Yet another example includes: driving a signal element of an antenna to radiate an electromagnetic communication signal therefrom. This signal element is carried on a first side of a dielectric layer that is opposite a second side carrying an electrical ground layer. Also included is applying a first antenna control signal to a parasitic element carried on the first side of the dielectric layer that extends along the first longitudinal side of the signal element and is spaced apart therefrom. In response to the first antenna control signal, an effective operating length of the parasitic element is changed relative to length of the signal element.

A different example is directed to providing a reconfigurable antenna including a first dielectric layer with a first side opposite a second side; where the first side carries a signal element and two parasitic elements and the second side carries an electrical ground layer. The parasitic elements each extend along opposing longitudinal sides of the signal element and are spaced apart therefrom. The parasitic elements each include a respective component operatively coupled between electrically conductive portions. In response to an electrical driving signal, this example includes generating an electromagnetic signal with the signal element and controlling the respective component of each of the parasitic elements to change a radiation pattern of the antenna from a first configuration to a second configuration.

Still a further example includes providing a reconfigurable antenna having a dielectric layer with the first side opposite a second side; where the first side carries a signal element and two parasitic elements, and the second side carries an electrical ground layer. The parasitic elements each extend along opposing longitudinal sides of the signal element, are each spaced apart therefrom, and each include a respective variable reactive component operatively coupled between two electrically conductive portions. In response to an electrical driving signal, this example includes generating an electromagnetic signal with the signal element and controlling the respective component of each of the parasitic elements to change a radiation pattern of the antenna from a first configuration to a second configuration.

Any experimental examples provided herein are not intended to limit the present invention to such examples or the corresponding results. Any theory of operation or finding described herein is merely intended to provide a better understanding of the present invention and should not be construed to limit the scope of the present invention as defined by the claims that follow to any stated theory or finding. While the invention has been illustrated and described in detail in the drawings and foregoing description, the same is to be considered as illustrative and not restrictive in character, it being understood that only the preferred embodiment has been shown and described and that all changes, modifications, and equivalents that come within the spirit of the invention as previously described or illustrated heretofore and/or defined by the following claims are desired to be protected.

What is claimed is:

1. An apparatus, comprising: a wireless communication device including communication signal processing circuitry, antenna control circuitry, and a reconfigurable antenna, the antenna including a multiple element antenna arrangement carried on a first side of a dielectric layer and an electrical ground layer carried on a second side of the dielectric layer opposite the first side, the arrangement including:

an electrically conductive signal element operatively coupled to the communication signal processing circuitry to radiate an electromagnetic signal in response to application of a corresponding electrical signal; and a first electrically conductive parasitic element extending along one longitudinal side of the signal element in a spaced apart relationship, the first parasitic element including an adjustable component operatively coupled to the antenna control circuitry, the component being operatively coupled between two electrically conductive portions of the first parasitic element and being responsive to the antenna control circuitry to directionally change a radiation pattern of the antenna.

2. The apparatus of claim 1, wherein the component includes at least one of a varactor and a variable inductor, a PIN diode, and a switch.

3. The apparatus of claim 1, further comprising a number of reconfigurable microstrip antennas structured to operate in a MIMO configuration.

4. The apparatus of claim 1, further comprising a number of reconfigurable microstrip antennas structured to operate in a phased array configuration.

5. The apparatus of claim 1, wherein the component is one or more of a switch and a variable reactive load and further comprising a second parasitic element extending along another longitudinal side of the signal element opposite the first parasitic element, the second parasitic element being configured the same as the first parasitic element.

6. The apparatus of claim 1, wherein:

the signal element is in the form of a longitudinal microstrip and the electrically conductive portions of the first parasitic element are each in the form of a microstrip; and the component is a first switch and the first parasitic element includes a second switch, one of the two portions is positioned between the first switch and the second switch, and the first parasitic element includes another electrically conductive microstrip portion coupled to the second switch.

7. The apparatus of claim 6, further comprising a second parasitic element extending along another longitudinal side of the signal element opposite the first parasitic element, the second parasitic element being configured the same as the first parasitic element.

8. An antenna device, comprising:

a dielectric layer with a first side opposing a second side;

an electrical ground layer carried on the first side of the dielectric layer;

an antenna arrangement carried on the second side of the dielectric layer, the arrangement including two parasitic microstrip elements and a microstrip signal element, the signal element being structured to radiate an electromagnetic communication signal in response to application of a corresponding electrical communication signal, the parasitic antenna elements extending along opposing longitudinal sides of the signal element and each being spaced apart therefrom, the parasitic antenna elements each including an adjustable component operatively connected between two microstrips, the adjustable component being structured to selectively adjust operable length of a respective one of the parasitic antenna elements to change a maximum radiation direction of the antenna device.

9. The antenna device of claim 8, wherein the adjustable component includes one or more of a switch and a variable reactive component.

10. The antenna device of claim 8, wherein the parasitic antenna elements each include a respective inductor, and the adjustable component is a varactor electrically coupled in series with the respective inductor.

11. The antenna device of claim 8, wherein the dielectric layer and the electrical ground layer are approximately planar.

12. The antenna device of claim 8, wherein the adjustable component is a first switch, the parasitic antenna elements each include a second switch, the second switch is operatively coupled between one of the two microstrips of a respective one of the parasitic antenna elements and a third microstrip of the respective one of the parasitic antenna elements, and the two microstrips and the third microstrip are longitudinally aligned for each of the parasitic antenna elements.

13. A method, comprising:

driving a signal element of an antenna to radiate an electromagnetic communication signal therefrom, the signal element being carried on a first side of a dielectric layer, the first side being opposite a second side carrying an electrical ground layer;

applying a first antenna control signal to a first parasitic element carried on the first side of the dielectric layer, the first parasitic element extending along a first longitudinal side of the signal element and being spaced apart therefrom; and in response to the first antenna control signal, changing an effective operating length of the first parasitic element relative to length of the signal element.

14. The method of claim 13, which includes applying a second antenna control signal to a second parasitic element carried on the first side of the dielectric layer, the second parasitic element extending along a second longitudinal side of the signal element and being spaced apart therefrom, the second longitudinal side being opposite the first longitudinal side.

15. The method of claim 13, wherein the first parasitic element includes a component operatively coupled between two microstrips, the component being one of a switch, a varactor, a capacitor, and an inductor.

16. The method of claim 15, wherein the component is a first switch and the first parasitic element includes a second switch and a third microstrip, the second switch being operatively coupled between one of the two microstrips and the third microstrip.

17. The method of claim 13, wherein the first parasitic element includes an adjustable reactive load responsive to the first antenna control signal and said changing includes reconfiguring a maximum radiation direction of the antenna.

18. A method, comprising:

providing a reconfigurable antenna including a dielectric layer with a first side opposite a second side, the first side carrying a signal element and two parasitic elements and the second side carrying an electrical ground layer, the parasitic elements each extending along opposing longitudinal sides of the signal element and each being spaced apart therefrom, the parasitic elements each including a respective component operatively coupled between two electrically conductive portions;

in response to an electrical driving signal, generating an electromagnetic signal with the signal element; and controlling the respective component of each of the parasitic elements to change a radiation pattern of the antenna from a first configuration to a second configuration.

19. The method of claim 18, wherein the signal element and the conductive portions are each a longitudinal microstrip and the respective component is one or more of a switch, a varactor, a capacitor, and an inductor.

20. The method of claim 18, which includes operating the reconfigurable antenna in at least one of a MIMO configuration and a phased array.

21. The method of claim 18, wherein the respective component is a respective varactor, and each of the parasitic elements includes a respective inductor electrically coupled in series with respective varactor.

22. The method of claim 18, wherein the parasitic elements each respond to said controlling to change effective operating length relative to length of the signal element.

* * * * *